United States Patent [19]

Amin et al.

[11] 4,334,731

[45] Jun. 15, 1982

[54] MEANS AND METHOD FOR INJECTING TELEVISION PICTURE TUBE BASES

[75] Inventors: Ramesh G. Amin, Itasca; Walter C. Hartman, Bolingbrook; Robert V. Husk, Wooddale, all of Ill.

[73] Assignee: Zenith Radio Corporation, Glenview, Ill.

[21] Appl. No.: 153,663

[22] Filed: May 27, 1980

[51] Int. Cl.[3] ..... H01R 33/74

[52] U.S. Cl. ..... 339/144 T; 313/318

[58] Field of Search ..... 339/144 R, 144 T, 145 R, 339/145 T; 313/318, 325

[56] References Cited

U.S. PATENT DOCUMENTS 4,127,313 11/1978 Marks ..... 339/144 T 4,211,465 7/1980 Puhak et al. ..... 339/144 T

*Primary Examiner*—Eugene F. Desmond

*Attorney, Agent, or Firm*—Ralph E. Clarke, Jr.

[57] ABSTRACT

A television cathode ray picture tube has a narrow neck terminated by a number of electrically conductive low-voltage pins and at least one high-voltage pin extending axially from the neck terminus. The tube according to the invention is characterized by having a base for passing and isolating said pins including a port adjacent to said terminus leading to a cavity surrounding the high-voltage pin. The cavity opens onto said terminus over a substantial portion of the area of the terminus. The port has acceptance means for connection to mating injector means for injecting the cavity with a metered amount of electrically insulative adhesive. The base provides for the injection of the adhesive in the exact location desired, and in an amount effective to fill the cavity and electrically isolate the high-voltage pin and adhere the base to the neck terminus. An improved method is also disclosed for electrically isolating the high-voltage pin and adhering a tube base to the neck terminus.

6 Claims, 4 Drawing Figures

MEANS AND METHOD FOR INJECTING TELEVISION PICTURE TUBE BASES

BACKGROUND OF THE INVENTION

This invention relates to television picture tubes, and is particularly concerned with the base of such tubes that provides for passing and isolating a number of electrically conductive pins that convey operating voltages into the tube envelope.

FIG. 1 depicts a representative base 10 which is attached to the terminus 11 of the narrow neck 12 of a cathode ray picture tube, the entirety of which is not shown. Neck 12 is terminated by a number of electrically conductive low-voltage pins 14, and at least one high-voltage pin 16; two such high voltage pins are shown in this example. As noted, pins 14 and 16 extend axially from the neck terminus 11. The potentials conducted by the low-voltage pins 14 may range from five volts to two kilovolts, while the potentials on the high-voltage pins 16 may range from four kilovolts to thirteen kilovolts. The resulting wide disparity in potentials between the closely spaced pins can lead to inter-pin arcing, the severity of which can damage television circuits and components and the associated electron gun in the tube neck. Also, such arcing can produce "arc tracks" on the base which, once established, can so degrade the high-voltage integrity of the base that the base must be replaced.

To provide for electrical isolation of the high-voltage pins 16 from the low-voltage pins 14, base 10 is shown as having a plurality of axially and radially outwardly extending insulating walls 18 which isolate the pins one from the other to prevent inter-pin arcing. The pins 16 which conduct a very high voltage may be further isolated from the low-voltage pins 14, and from each other, by an elaborate system of insulating walls and cavities. A base of this type which, in conjunction with a socket system, provides for high voltage arc prevention between adjacent pins is described and claimed in U.S. Pat. No. 4,075,531, assigned to the asignee of the present invention.

It is a common practice to supplement the insulation provided by the base by the addition of an electrically insulative material into a cavity 20 surrounding high-voltage pins 16. It will be seen that the cavity 20 opens onto terminus 11. The electrically insulative material is usually injected into the base 10 through an aperture 22 at the end of the base from the direction indicated by the arrow 24. The aperture 22 leads to an opening in the base 10 for receiving the hermetical seal tip of the tubulation (not shown) that extends from the terminus 11 of neck 12 following the tube evacuation and tip-sealing process. The insulative material 26, indicated graphically by dots, flows up into the opening in base 10 and into cavity 20 where it surrounds high-voltage pins 16. To ensure that the insulative material 26 completely fills cavity 20, a surplus of the material 26 is injected which exudes from the space between base 10 and neck terminus 11, as indicated graphically.

The insulative material 26 is also an adhesive which provides for adhering base 10 to neck terminus 11. The insulative material may comprise a thermo-setting polymer adhesive. The injection means is usually a hand-held, gun-type tool that utilizes air pressure to force the insulative material into the base.

The process of installing the base and injecting the insulative material during cathode ray picture tube manufacture is as follows: All pins are straightened so that the base 10 may be passed over the pins 14 and 16. The insulative material 26 is then injected by the means described. Any excess which exudes from between base 10 and neck terminus 11 is wiped off manually.

This seemingly simple process normally requires four production personnel: one to straighten the pins and install the base, one to inject the insulative material using the tool described, and two to wipe off the excess insulative material. Over three grams of the insulative material must be injected to ensure complete insulation of the high-voltage pins and positive adherence of the base to the neck terminus.

OBJECTS OF THE INVENTION

It is a general object of this invention to provide improved means and method for the manufacture of television cathode ray picture tubes.

It is a less general object of the invention to provide improved means and method for injecting insulative material into the base of the cathode ray tube.

It is a more specific object of the invention to provide for the reduction of labor and material cost in the manufacture of cathode ray picture tubes.

It is a specific object to provide improved means and method for insulating the high-voltage pins entering the base of the cathode ray tube, and for adhering the base to the neck terminus.

BRIEF DESCRIPTION OF THE DRAWINGS

The features of the present invention which are believed to be novel are set forth with particularity in the appended claims. The invention, together with further objects and advantages hereof, may best to be understood by reference to the following description taken in conjunction with the accompanying drawings, in the several figures of which like reference numerals identify like elements, and in which:

DESCRIPTION OF THE PREFERRED EMBODIMENTS

Figure 1:
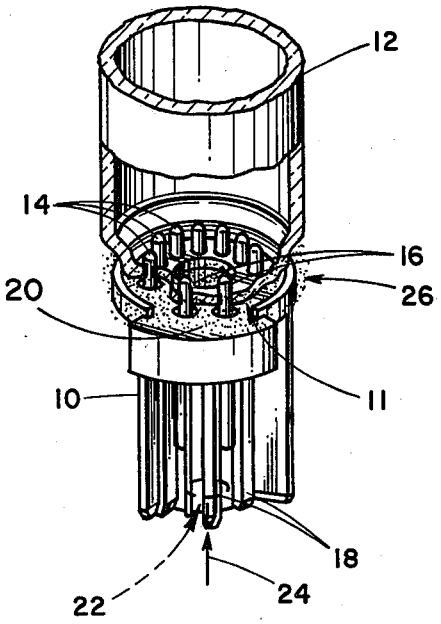
Fig. 1 PRIOR ART
FIG. 1 is a perspective view partially broken away depicting details of a prior art means for supplementing the insulation in the base of a cathode ray tube.
Figure 2:
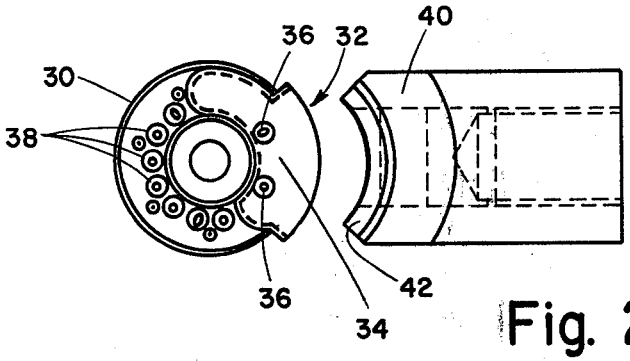
FIG. 2 is a plan view partially in section of a cathode ray tube base depicted as being adjacent to mating injector means according to the invention.
Figure 3:
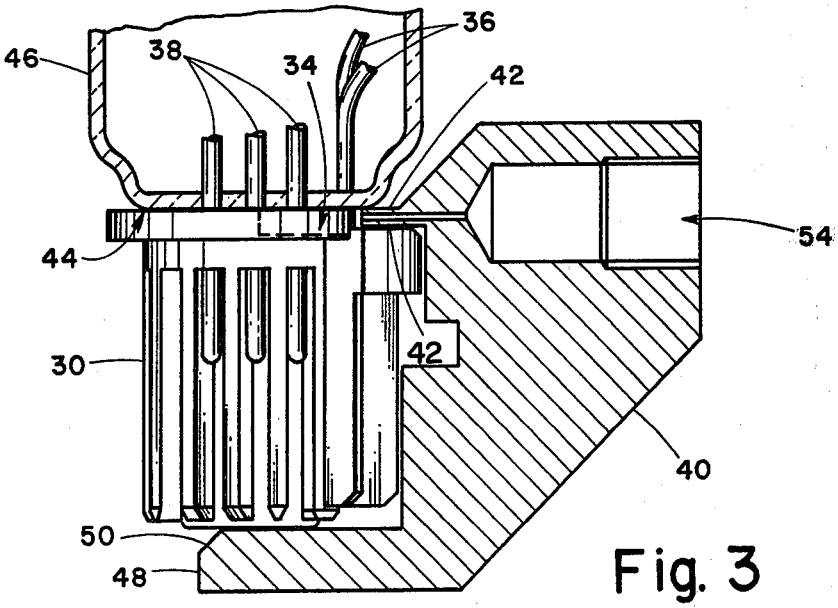
FIG. 3 is a view in elevation and in section of the mating of the base and injector means depicted in FIG. 2.
Figure 4:
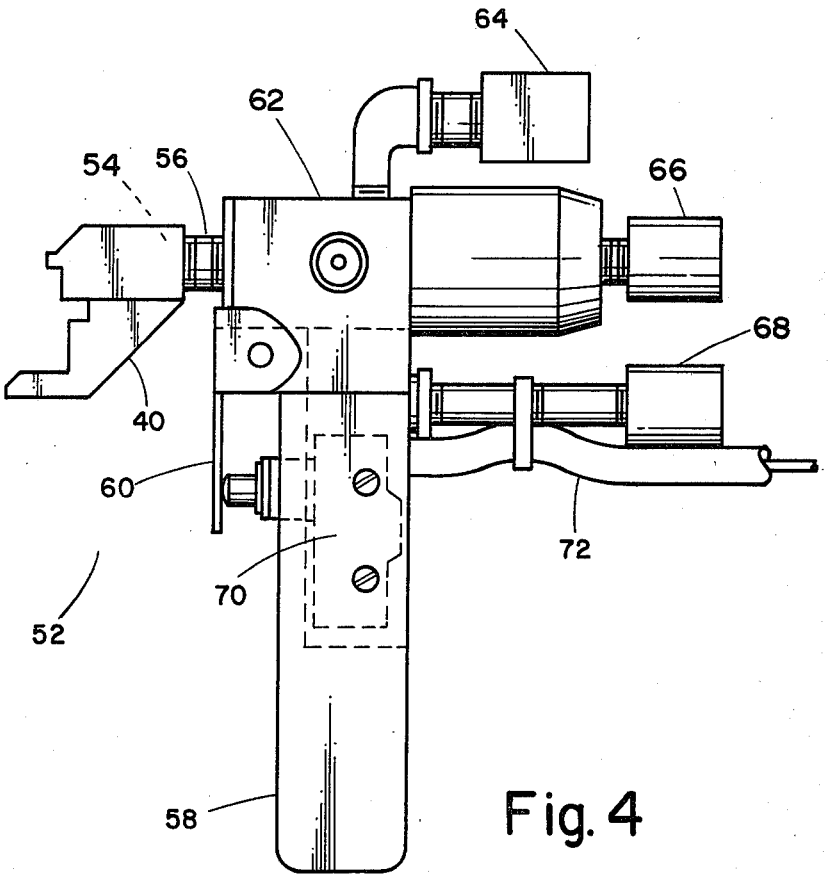
FIG. 4 is a side view of gun means for injecting insulative material into the tube base.

The means according to the invention are depicted by FIGS. 2–4. With initial reference to FIGS. 2 and 3, there is provided according to the invention a base 30 having a port 32 adjacent to the neck terminus 44 and leading to a cavity 34 in base 30; the boundaries of the cavity 34 are indicated by the dash lines. It will be noted that the cavity 34 is larger than the cavity 20 depicted by FIG. 1; the purpose of the enlarged cavity will be disclosed infra. At least one high-voltage pin, shown in this embodiment as being two pins 36, are depicted as being surrounded by cavity 34. A number of low-voltage pins 38 are shown as being adjacently located to high-voltage pins 36, but outside the area of cavity 34.

Port 32 is shown as having acceptance means for connection to mating injector means 40 which includes means for aligning the port 32 with the injector means 40 and supporting the base 30 against the neck terminus 44. The mating injector means 40 is shown in FIG. 2 as being adjacent to port 32 in base 30. Port 32 provides for injecting cavity 34 with a metered amount of electrically insulative adhesive. The acceptance means of port 32 are indicated as comprising narrow lip means 42 which are conformed as indicated to mate with port 32. The configuration of the mating injector means 40 is shown also by FIG. 3 wherein base 30 is shown as passing and isolating electrically conductive low-voltage pins 38 and the two high-voltage pins 36 which extend axially from the terminus 44 of the narrow neck 46 of the cathode ray tube (not shown) to which base 30 is attached.

Injector means 40 is depicted as including means for supporting base 30 against neck terminus 34. The support means is shown as comprising a ledge 48. This support is considered necessary because before the base 30 is permanently adhered to terminus 44, the base 30 is temporarily held adjacent to terminus 44 only by the slight friction of the pins 36 and 38 which press against the base 30 in passing through the base. The base is supported by ledge 48 by means of the upward pressure exerted by the operator of the injection tool when injecting cavity 34. Chamfer 50 of the ledge 48 aids as well in the aligning and mating of the injector means 40 with port 32.

FIG. 4 depicts a gun means 52 which, in conjunction with mating injector means 40 according to the invention, provides for injecting insulative adhesive into base 30. Injector means 40 is shown as being connected to gun means 52 by means of a threaded orifice 54 in injector means 40 which receives nipple 56. Gun means 52 includes a stock 58 and a trigger 60 for manually gripping and activating the injector means. A dispense control section 62 provides for controlling the injection of the insulative adhesive; this part of gun means 42 may be the type of component supplied by Sealant Equipment and Engineering, Inc., Oak Park, Mich., under the designation Model 190 2100-29, "automatic, air-operated high-pressure snuffer gun." At the end of the dispense cycle, the "snuffer gun" sucks back a small amount of the dispensed material to prevent dripping or oozing from the injector means 40. The insulative adhesive is conducted from a reservoir to the dispense control section 62 through a connector 64 and the flexible hose (not shown). Connections 66 and 68 provide for connection through flexible hoses to a compressed air supply. Depressing trigger 60 closes normally open electrical switch 70 which activates associated standard metering equipment (not shown) through conductor 72. The metering equipment regulates the flow of insulative adhesive from the reservoir for injecting the desired amount of insulative adhesive into base 30.

Base 30 provides according to the invention for injecting cavity 34 with an electrically insulative adhesive in the exact location desired and in an amount effective to fill the cavity 34 and contact neck terminus 44. To prevent clogging of the injection apparatus, it is desirable that the adhesive properties of the material be exhibited subsequent to the injection process, otherwise the injection means will quickly become clogged. The necessary combination of effective insulation and positive adherence is provided by a silicone-based, thermosetting polymer adhesive. An example of such an adhesive is known as Silastic TM manufactured by General Electric under the designation silicone adhesive CRTV6424. Upon heating, the Silastic becomes an elastomer with highly insulative and adhesive qualities. Heating of the Silastic to provide adhesion is normally accomplished by suspending the tube from a conveyor and passing the base end through a lehr that applies approximately 150–170 degrees centrigrade of heat to the base for about fifteen minutes.

It will be observed that the cavity 34 of base 30 opens onto terminus 44 over a substantial portion of the area of terminus 44; i.e., the entire area other than that occupied by the low-voltage pins 38. When the enlarged area is injected with the adhesive, positive adherence of the base 30 to the neck terminus thus enhanced. The benefit of the invention is such that the precise amount of the adhesive is injected in the exact location desired to electrically isolate the high-voltage pins and adhere the base to the neck terminus.

For example, production experience has shown that, by the application of the means and method according to the invention, only 0.8 grams of insulative adhesive is required to achieve optimum electric isolation of the high voltage pins and adherence of the base to the neck terminus. This represents of saving of approximately 75% in the amount of insulative adhesive otherwise required. Another cost advantage is that only two persons are required for the manufacturing process, one to install the base, and a second to inject the adhesive. There is no need for additional personnel to wipe off excess material as there is no excess. It can be seen that the savings material and labor in large production runs is substantial. A further advantage is in quality: positive impregnation of the critical high-voltage breakdown prone area with the adhesive guarantees that there will be no arc-inducing voids in the insulation surrounding the high voltage pins.

Other changes may be made in the above-described method without departing from the true scope of the invention herein involved, and it is intended that the subject matter in the above depiction shall be interpreted as illustrative and not in a limiting sense.

We claim:

1. In a television cathode ray picture tube having a narrow neck terminated by a number of electrically conductive low-voltage pins and at least one high-voltage pin extending axially from the neck terminus, said tube being characterized by having a base for passing and isolating said pins, said base including a port in the side of said base and adjacent to said terminus leading to a cavity surrounding said high-voltage pin, said cavity opening onto said terminus over a substantial portion of the area of said terminus, said port having acceptance means for connection to mating injector means for injecting said cavity with a metered amount of electrically insulative adhesive, such that said base provides for the injection of said adhesive in the exact location desired, and in an amount effective to fill said cavity and electrically isolate said high-voltage pin and adhere said base to said neck terminus.

2. A base for a television cathode ray picture tube having a narrow neck terminated by a number of electrically conductive low-voltage pins and at least one high-voltage pin extending axially from the neck terminus, said base providing for passing and isolating said pins and being characterized by having a port in its side adjacent to said terminus leading to a cavity surrounding said high-voltage pin, said cavity opening onto said terminus over a substantial portion of the area of said terminus, said port having acceptance means for connection to mating injector means for injecting said cavity with a metered amount of electrically insulative adhesive, such that said base provides for the injection of said adhesive in the exact location desired, and in an amount effective to fill said cavity and electrically isolate said high-voltage pin and adhere said base to said neck terminus.

3. For use in the manufacture of a television picture tube having a narrow neck terminated by a number of electrically conductive low-voltage pins and at least one high-voltage pin extending axially from the neck terminus, and including a base for passing and isolating said pins, said base having a cavity surrounding said high-voltage pin and opening onto said terminus, an improved method for electrically isolating said high voltage pin and adhering said base to said neck terminus, comprising:

providing a base having a port in its side adjacent to said terminus and leading to said cavity;

connecting said port to mating injector means including means for aligning said port with said injector means and supporting said base against said terminus;

injecting said cavity with an electrically insulating adhesive in an amount effective to fill said cavity and contact said terminus;

such that the precise amount of said adhesive is provided in the exact location desired to electrically isolate said high voltage pin and adhere said base to said neck terminus.

4. For use in the manufacture of a television picture tube having a narrow neck terminated by a number of electrically conductive low-voltage pins and at least one high-voltage pin extending axially from the neck terminus, and including a base for passing and isolating said pins, said base having a cavity surrounding said high-voltage pin and opening onto said terminus, an improved method for electrically isolating said high voltage pin and adhering said base to said neck terminus, comprising:

providing a base having a port in its side adjacent to said terminus;

providing said port with narrow lip means and conforming said lip means to electrically insulating adhesive injector means;

connecting said injector means to said port by aligning and mating said narrow lip means with said injector means;

extending a ledge from said injector means for supporting said base against said terminus by upward pressure exerted by an operator;

aiding in aligning and mating said narrow lip means of said port with said injector means by providing a chamfer in said ledge;

injecting said cavity with an electrically insulative thermo-setting polymer adhesive in an amount sufficient to fill said cavity and contact said terminus;

setting said polymer by exposing said base to heat;

such that the precise amount of said polymer adhesive is provided in the exact location desired to electrically isolate said high voltage pin and adhere said base to said neck terminus.

5. The method according to claim 4 wherein said polymer adhesive comprises a silicone potting resin.

6. The method according to claim 4 wherein said potting resin comprises General Electric silicone adhesive CRTV6424, known as Silastic TM.

* * * * *